United States Patent [19]

Bonne

[11] Patent Number: 4,497,438

[45] Date of Patent: Feb. 5, 1985

[54] ADAPTIVE, MODULATING BOILER CONTROL SYSTEM

[75] Inventor: Ulrich Bonne, Hopkins, Minn.

[73] Assignee: Honeywell Inc., Minneapolis, Minn.

[21] Appl. No.: 452,533

[22] Filed: Dec. 23, 1982

[51] Int. Cl.[3] ..... F24D 3/00

[52] U.S. Cl. ..... 237/8 R; 236/42; 236/99 E

[58] Field of Search ..... 237/8 R, 2 A, 9; 236/32, 99 E, 12 R, 42; 126/374, 351

[56] References Cited

U.S. PATENT DOCUMENTS 1,278,068 9/1918 MacDonald ..... 237/8 R 4,294,402 10/1981 Vollmer ..... 236/12 R

FOREIGN PATENT DOCUMENTS 2948797 4/1979 ..... 237/8 R

*Primary Examiner*—Henry Bennett

*Attorney, Agent, or Firm*—Omund R. Dahle

[57] ABSTRACT

A non-electrical thermo-mechanical control system for a hot water heating system having a modulating burner in the boiler. The thermo-mechanical control system simultaneously controls fuel and air supply to the burner in dependence on the temperature difference between forward water temperature to the radiators and return water temperature from the radiators.

6 Claims, 4 Drawing Figures

ADAPTIVE, MODULATING BOILER CONTROL SYSTEM

BACKGROUND AND SUMMARY OF THE INVENTION

The present invention is directed to a non-electrical thermo-mechanical boiler control system for simultaneously controlling fuel and air supply to a burner in dependence on the temperature difference between forward water to the radiators and return water from the radiators of a hot-water heating installation having thermostatic radiator valves associated with each of the radiators.

In the prior art such as German patent application No. P 2948797.6 filed by F. Salzmann, December 1979, there is disclosed an electronic system for controlling an on-off mode the burner for a boiler. The electronic control system for regulating the water temperature in the domestic boiler heating system which has valve controlled radiators, measures the difference between forward-flow temperature and return-flow temperature of the hot water and feeds it into a microcomputer to control the on-off switching of the burner. In the U.S. Pat. No. 4,294,402, assigned to the same assignee as the present invention, the temperature difference between forward water temperature and return water temperature is used to control a mixing valve but not to control the burner itself.

In the present invention a modulating burner has both the air supply and the fuel supply controlled in dependence on the temperature difference between forward water temperature and return water temperature.

$$E_1 = Ah(T_F - \Delta T/2 - T_o)$$

$$E_1 = \dot{m} C_p \Delta T$$

DESCRIPTION

Figure 1:
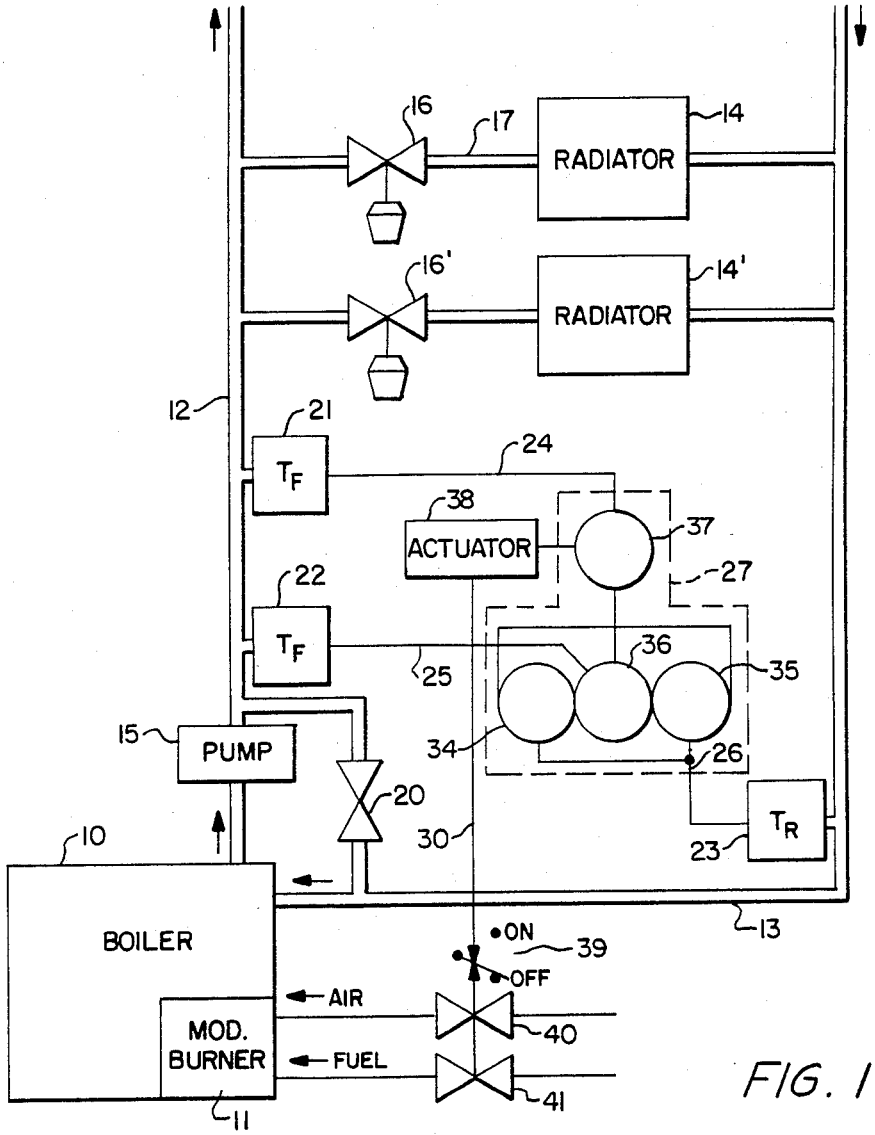
FIG. 1 is a diagrammatic block schematic of a complete boiler system according to the invention.

Referring now to the system block diagram of FIG. 1, a heating installation includes a central boiler 10 which is heated by means of a modulating burner 11, such as a modulating gas burner or an oil burner. Associated with the boiler is a forward-flow system 12 and a return-flow system 13 which circulate the water through individual radiators 14 and 14' by means of a circulating pump 15. A thermostatic valve 16 is installed in the connecting line 17 of the radiator 14 to control the flow of water to the radiator in dependence on the heat requirement of the area in which the radiator is located. A similar thermostatic valve 16' is installed in the connecting line of the radiator 14'. The forward-flow system is also connected with the return-flow system through a pump unloading shunt valve 20, i.e. a relief valve.

The forward-flow line 12 is provided with a first forward water temperature sensor 21 and a second forward water temperature sensor 22, and the return-flow line 13 is provided with a return water temperature sensor 23. Sensors 21 and 23 are liquid filled sensors in which the liquid has a high temperature coefficient of expansion. These thermo-mechanical (liquid-filled preferably with toluene) sensors 21, 22 and 23 are shown more pictorially in FIG. 2. Sensor 22 differs from the other two in having an adjustment knob which extends or contracts a bellows within the sensor to control the liquid volume within the sensor 22. The three sensors 21, 22 and 23 are each connected by tubing 24, 25 and 26, respectively, to a liquid-filled controller assembly 27. The controller assembly 27 comprises expansion actuator components 34, 35 and 36 and a reset actuator 37. Tubing 24 connected liquid-filled sensor 21 to the reset actuator 37, tubing 25 connects sensor 22 to the expansion actuator 36 and tubing 26 connects return water sensor 23 to the expansion actuator components 34 and 35. Also connected to the tubing 24 is an expansion actuator 38. A piston rod 30 extending from expansion actuator 38 connects to an ignition switch 39, an air modulation valve 40 and a fuel modulation valve 41.

Figure 2:
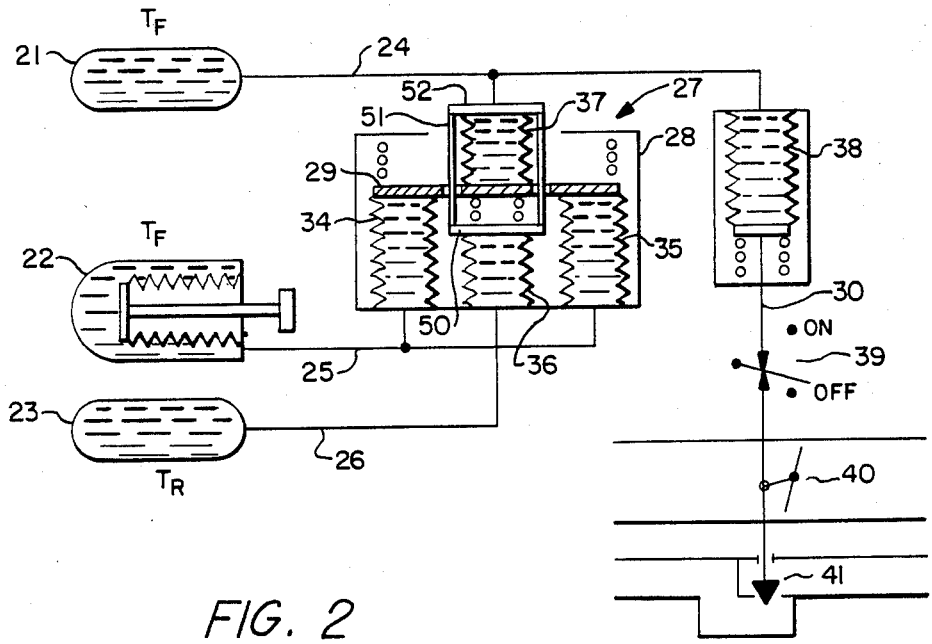
FIG. 2 shows in more detail the thermo-mechanical control system of FIG. 1.

More specifically in FIG. 2, the controller assembly 27 has a surrounding enclosure 28 into the bottom of which is mounted liquid filled bellows 34 and 35 with bellows 36 mounted inbetween. Extending from one to the other across the top of bellows 34 and 35 is a plate 29. The cover plate 29 is held against the top of bellows 34 and 35 by a compression spring bearing against the enclosure upper wall. Thus, as the liquid in sensor 22 expands (or the adjustment knob is moved to decrease the volume in sensor 22), it moves into bellows 34 and 35 to raise plate 29. The bottom of bellows 37 is fastened onto the top of plate 29 and thus the upward movement of plate 29 tends to compress bellows 37 and force liquid from it into bellows 38. Bellows 36 also works together with bellows 37 to adjust the system. As has been identified, bellows 36 which is mounted into the bottom of enclosure 28 between bellows 34 and 35, has a top cover plate 50 which is biased below plate 29 by a compression spring. Extending upward from opposite sides of plate 50 and through an opening in plate 29 are a pair of rigid members, such as rods 51, which terminate at top plate 52 of bellows 37. Plate 50 and plate 52 are thus constrained to move together. Thus, as the liquid in adjustable $T_R$ sensor 23 expands, the plate 50 tends to rise which then pushes up plate 52 by an equal amount. This forces some of the liquid in bellows 38 to move into bellows 37 so that rod 30 moves upwardly. The compression spring between plates 50 and 29 needs to be stronger than the spring at bellows 38 to assure that the adjustment screw in sensor 22 does not lose contact.

The control system so far described operates without a mixing valve and adapts the water temperature to load demand to minimize the use of fuel. The modulating control system as described is a thermo-mechanical system, that is, a non-electrical system. Such a system, using liquid-filled thermo-mechanical actuators, based on resetting the boiler water temperature according to the measured difference ($\Delta T$) between forward water ($T_F$) and return water ($T_R$) and a stored $T_F$ vs $\Delta T$ is herein described. Since individual heating system needs may vary depending on whether baseboard, floor or large radiator type heat exchangers are selected, a manual adjustment is included in sensor 22 to tailor the control response to individual needs.

To understand the performance of the system it was found helpful to look at the relations between the involved parameters: the equations governing the energy (heat) provided by a hydronic heating system are those describing the heat transferred from the radiators of surface area A to the heated room:

$$E_1 = Ah(T_F - \Delta T/2 - T_o) \quad (1)$$

The sensible heat given away by the water:

$$E_2 = \dot{m}c_p\Delta T \quad (2)$$

where h=heat transfer coefficient, $T_o$=room temperature, m=water mass flow rate and $c_p$=specific heat of the water.

Figure 3:
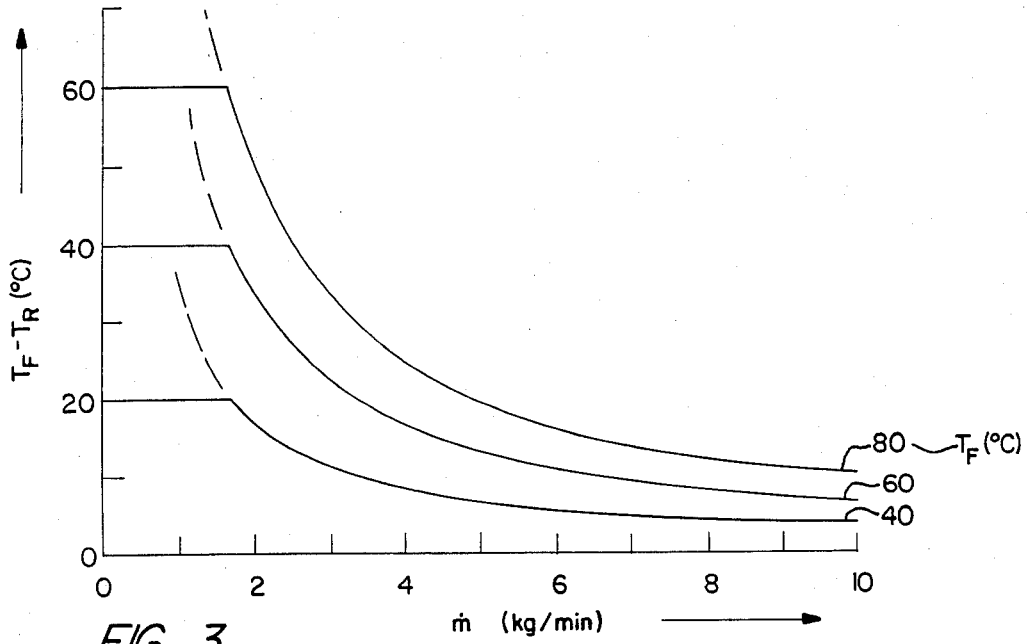
FIG. 3 shows graphically the heating system water temperature drop vs mass flow, for various forward water temperatures when room temperature is 20° C. and constant energy use.
Figure 4:
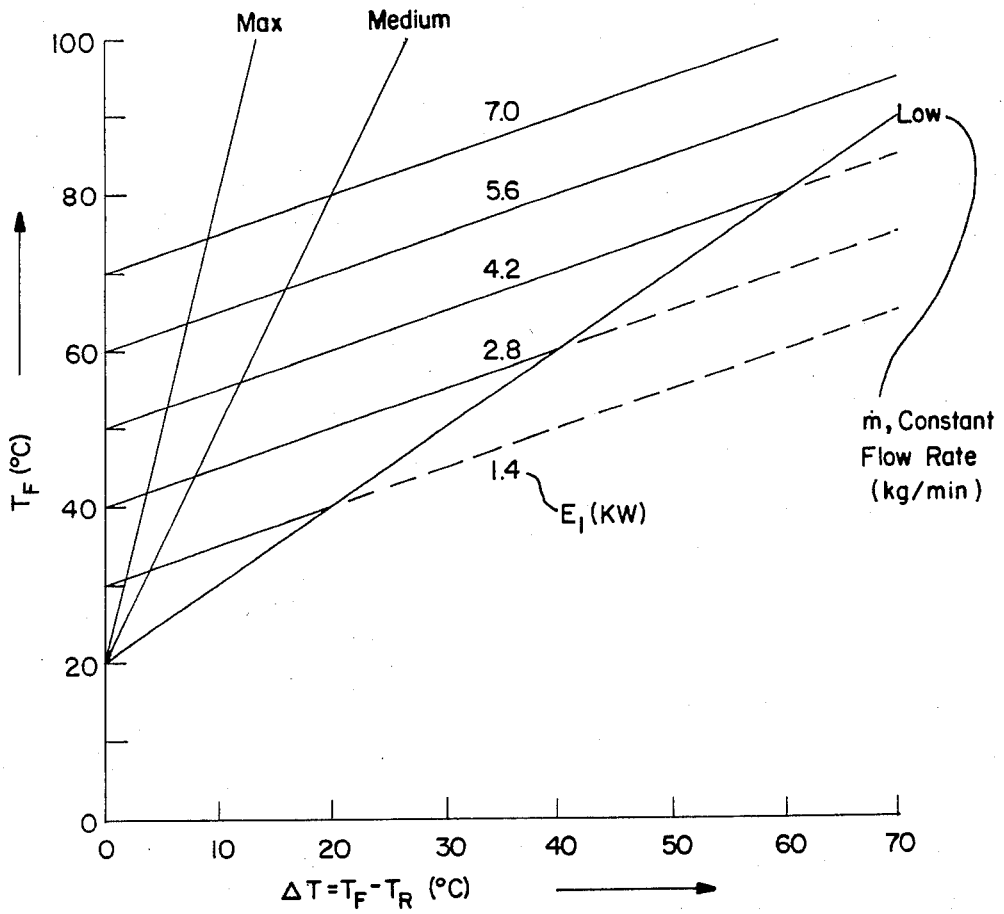
FIG. 4 shows graphically the boiler water temperatures under conditions of constant mass flow ($\dot{m}$) and constant total energy output ($E_1$) in the equations.

The curves of FIG. 3 are a representation of equation (2), each at constant energy, for various forward temperatures. Thus FIG. 3 shows graphically the heating system water temperature drop vs mass flow m, for various forward water temperatures ($T_F$) when room temperature $T_o$ is 20° C. and for constant energy use along each curve. Equation (1) is represented by the lines of constant energy in FIG. 4. In the same figure, lines of constant flow at maximum, medium and low rates were plotted to indicate the relation between $T_F$ and $\Delta T$. The relation may be expressed generally along the following lines: (1) $\Delta T$ adopts maximum values when the demand for heat is satisified, and the thermostatic radiator valves (TRV) are closed, leading to minimum flow, (2) $\Delta T$ adopts the minimum values when the demand for heat is high, the TRV's are fully open and the circulating pump can pump at maximum flow rate, (3) at some medium flow value (5 kg/min) in FIG. 4, the TRV's operate at maximum control effectiveness, and $T_F$ adopts the values of the corresponding $T_F$ vs $\Delta T$ line. FIG. 4 shows how a given energy output command, $E_1$, can be satisfied with maximum, medium or low water flow rate indicated by the intersections between these flow lines and the $E_1$ lines.

That desired particular line or functional relationship can be dialed in by turning the adjustment knob of sensor 22. In doing this, the liquid volume in sensor 22 is either (a) reduced, squeezed into bellows 34 and 35, which causes reset actuator 37 to expand, expansion actuator 38 to contract and to open the gas valve more. This would shift the "medium" line towards higher $T_F$ values, or (b) increased, which ultimately would shift (really pivot around) ($\Delta T=0$, $T_F=20$) towards lower values of $T_F$.

FIG. 4 also shows a boiler water cooling line (dotted when no more fuel is provided. The action of the aquastat, formed by the combination of devices nr. 21, 37, 38 and 39 differential is not included in FIG. 4 for the sake of simplicity.

The modulating damper 40 and valve 41, are linked to the bellows movement of expansion actuator 38 so that the firing rate can be modulated according to heat demand at maximum efficiency. This system allows the elimination of the conventional water mixing valve. The modulating scheme helps to avoid possible pipe expansion noises. Thus the above described novel thermo-mechanical boiler control system operates without a mixing valve or outdoor temperature sensor to minimize installation costs, adapts the water temperature to load demand to maximize conservation of energy usage and except when the system is expanded to include setback, does not need any additional indoor or outdoor sensors.

The embodiments of the invention in which an exclusive property or right is claimed are defined as follows:

1. A thermo-mechanical control apparatus for a modulated burner hot water heating system comprising:

a pair of temperature sensors of the liquid fill type, one of said sensors adapted to sense boiler output temperature and the second of said sensors adapted to sense return flow temperature to the boiler;

a third temperature sensor of the liquid fill type, said third temperature sensor being adjustable in volume for manual reset purposes, said third sensor being adapted to sense boiler output temperature;

a thermo-mechanical actuator comprising first liquid filled actuator means, second liquid filled actuator means, and, liquid filled reset expansion actuator means, having an output port, wherein said thermo-mechanical actuator includes at least three bellows as said first, second and reset liquid filled actuator means, said first liquid filled actuator means being mounted to cause compression of said reset actuator means when said first means is expanded, said second liquid filled actuator means being mounted to cause expansion of said reset actuator means when said second means is expanded;

a liquid filled main expansion actuator, adapted to adjust the fuel and air of a modulated burner;

first capillary tube means connecting said one sensor in controlling relation to said liquid filled main expansion actuator and connecting the output port of said reset actuator means to said main expansion actuator so that both the one temperature sensor and the output of said reset actuator means control the setting of said main expansion actuator;

second capillary tube means connecting said second sensor to said second liquid filled expansion actuator means of said thermo-mechanical actuator;

third capillary tube means connecting said third sensor to said first liquid filled expansion actuator means of said thermo-mechanical actuator.

2. A thermo-mechanical control apparatus for a modulated burner hot water heating system comprising:

a pair of temperature sensors of the liquid fill type, one of said sensors adapted to sense boiler output temperature and the second of said sensors adapted to sense return flow temperature to the boiler;

a third temperature sensor of the liquid fill type, said third temperature sensor being adjustable in volume for manual reset purposes, said third sensor being adapted to sense boiler output temperature wherein said liquid fill of said sensors is toluene which has a high temperature coefficient of expansion;

a thermo-mechanical actuator comprising first liquid filled actuator means, second liquid filled actuator means, and, liquid filled reset expansion actuator means, having an output port, said first liquid filled actuator means being mounted to cause compression of said reset actuator means when said first means is expanded, said second liquid filled actuator means being mounted to cause expansion of said reset actuator means when said second means is expanded;

a liquid filled main expansion actuator, adapted to adjust the fuel and air of a modulated burner;

first capillary tube means connecting said one sensor in controlling relation to said liquid filled main expansion actuator and connecting the output port of said reset actuator means to said main expansion actuator so that both the one temperature sensor and the output of said reset actuator means control the setting of said main expansion actuator;

second capillary tube means connecting said second sensor to said second liquid filled expansion actuator means of said thermo-mechanical actuator;

third capillary tube means connecting said third sensor to said first liquid filled expansion actuator means of said thermo-mechanical actuator.

3. A thermo-mechanical control apparatus for a modulated burner hot water heating system comprising:

a pair of temperature sensors of the liquid fill type, one of said sensors adapted to sense boiler output temperature and the second of said sensors adapted to sense return flow temperature to the boiler;

a third temperature sensor of the liquid fill type, said third temperature sensor being adjustable in volume for manual reset purposes, said third sensor being adapted to sense boiler output temperature;

a thermo-mechanical actuator comprising first liquid filled actuator means, second liquid filled actuator means, and, liquid filled reset expansion actuator means, having an output port, said first liquid filled actuator means being mounted to cause compression of said reset actuator means when said first means is expanded, said second liquid filled actuator means being mounted to cause expansion of said reset actuator means when said second means is expanded;

a liquid filled main expansion actuator, adapted to adjust the fuel and air of a modulated burner wherein said main expansion actuator is an axially expandable bellows driving an axially mounted connecting rod;

first capillary tube means connecting said one sensor in controlling relation to said liquid filled main expansion actuator and connecting the output port of said reset actuator means to said main expansion actuator so that both the one temperature sensor and the output of said reset actuator means control the setting of said main expansion actuator;

second capillary tube means connecting said second sensor to said second liquid filled expansion actuator means of said thermo-mechanical actuator;

third capillary tube means connecting said third sensor to said first liquid filled expansion actuator means of said thermo-mechanical actuator.

4. A thermo-mechanical control apparatus for a modulated burner hot water heating system comprising:

a pair of temperature sensors of the liquid fill type, one of said sensors adapted to sense boiler output temperature and the second of said sensors adapted to sense return flow temperature to the boiler;

a third temperature sensor of the liquid fill type, said third temperature sensor being adjustable in volume for manual reset purposes, said third sensor being adapted to sense boiler output temperature wherein said third temperature sensor has an internal adjustable volume displacement means with internal adjustment knob;

a thermo-mechanical actuator comprising first liquid filled actuator means, second liquid filled actuator means, and, liquid filled reset expansion actuator means, having an output port, said first liquid filled actuator means being mounted to cause compression of said reset actuator means when said first means is expanded, said second liquid filled actuator means being mounted to cause expansion of said reset actuator means when said second means is expanded;

a liquid filled main expansion actuator, adapted to adjust the fuel and air of a modulated burner;

first capillary tube means connecting said one sensor in controlling relation to said liquid filled main expansion actuator and connecting the output port of said reset actuator means to said main expansion actuator so that both the one temperature sensor and the output of said reset actuator means control the setting of said main expansion actuator;

second capillary tube means connecting said second sensor to said second liquid filled expansion actuator means of said thermo-mechanical actuator;

third capillary tube means connecting said third sensor to said first liquid filled expansion actuator means of said thermo-mechanical actuator.

5. A thermo-mechanical control apparatus for a modulated burner hot water heating system comprising:

a pair of temperature sensors of the liquid fill type, one of said sensors adapted to sense boiler output temperature and the second of said sensors adapted to sense return flow temperature to the boiler;

a third temperature sensor of the liquid fill type, said third temperature sensor being adjustable in volume for manual reset purposes, said third sensor being adapted to sense boiler output temperature;

a thermo-mechanical actuator comprising first liquid filled actuator means, second liquid filled actuator means, and, liquid filled reset expansion actuator means, having an output port, said first liquid filled actuator means being mounted to cause compression of said reset actuator means when said first means is expanded, said second liquid filled actuator means being mounted to cause expansion of said reset actuator means when said second means is expanded, wherein the thermo-mechanical actuator includes an outer housing supporting within the housing said first liquid filled expansion actuator means in the form of bellows means having one end thereof mounted to said housing and having the other expandable end bearing against a compression spring loaded plate, said outer housing also supporting within the housing said second liquid filled expansion actuator means in the form of second bellows means having one end thereof mounted to said housing and having an upper expandable end, said outer housing also substantially enclosing said liquid filled reset expansion actuator means which is in the form of a third bellows means which third bellows means has its lower surface mounted to said spring loaded plate and which has its upper end connected to and drives by the motion of the upper expandable end of said second bellows;

a liquid filled main expansion actuator, adapted to adjust the fuel and air of a modulated burner;

first capillary tube means connecting said one sensor in controlling relation to said liquid filled main expansion actuator and connecting the output port of said reset actuator means to said main expansion actuator so that both the one temperature sensor and the output of said reset actuator means control the setting of said main expansion actuator;

second capillary tube means connecting said second sensor to said second liquid filled expansion actuator means of said thermo-mechanical actuator;

third capillary tube means connecting said third sensor to said first liquid filled expansion actuator means of said thermo-mechanical actuator.

6. Thermo-mechanical control apparatus for a heating installation comprising:

a main control actuator (38) for simultaneously adjusting air flow and fuel flow to a modulating burner of a boiler;

a forward flow water line (12) from the boiler to the radiators;

a return flow water line (13) to the boiler from the radiators;

a first liquid-filled temperature sensor (21) mounted to sense the water temperature in said forward flow line, said liquid fill having a large temperature coefficient of expansion;

a similar liquid-filled temperature sensor (23) mounted to sense the water temperature in said return flow line;

an adjustable volume liquid-filled temperature sensor (22) mounted to sense the water temperature in said forward flow line;

first capillary tube means (24) connecting the output of said first sensor (21) in controlling relation to said main control actuator (38);

liquid-filled reset actuator means (37) having a movable top member (52) and a movable bottom member (29), the movement of either changing the internal volume of said liquid-filled reset actuator means, said means having an output port connected to said first capillary tube means (24) for reset of said main control apparatus (38);

second liquid-filled actuator means (36) having an input connected by a second capillary tube (26) to said similar temperature sensor (23) whereby liquid expansion in said similar sensor causes expansion of said second actuator means (36);

means (51) mechanically connecting said second actuator means (36) to said reset actuator means top member (52) such that expansion of said second actuator increases internal volume of said reset actuator means (37); and, third liquid-filled actuator means (34,35) having an input connected by a third capillary tube (25) to said adjustable volume liquid-filled temperature sensor (22), said third actuator means (34,35) being connected to control the position of the movable bottom member (29).

* * * * *